US012790065B2

(12) United States Patent
Salnars

(10) Patent No.: US 12,790,065 B2
(45) Date of Patent: Nov. 10, 2026

(54) AIR STACKING PRODUCE CONTAINER

(71) Applicant: Del Monte International GmbH, Zug (CH)

(72) Inventor: Christian Salnars, Coral Gables, FL (US)

(73) Assignee: Del Monte International GMBH, Zug (CH)

( * ) Notice: Subject to any disclaimer, the term of this patent is extended or adjusted under 35 U.S.C. 154(b) by 175 days.

(21) Appl. No.: 18/628,313

(22) Filed: Apr. 5, 2024

(65) Prior Publication Data

US 2024/0336393 A1 Oct. 10, 2024

Related U.S. Application Data

(60) Provisional application No. 63/494,427, filed on Apr. 5, 2023.

(51) Int. Cl.
*B65D 5/00* (2006.01)
*B65D 5/42* (2006.01)
*B65D 85/34* (2006.01)

(52) U.S. Cl.
CPC ..... *B65D 5/0015* (2013.01); *B65D 5/4295* (2013.01); *B65D 85/34* (2013.01); *B65D 2205/02* (2013.01)

(58) Field of Classification Search
CPC .... B65D 5/001; B65D 5/0015; B65D 5/4295; B65D 85/34
USPC .... 229/915, 916, 120–120.1, 127, 143, 178, 229/919, 122.32, 148
See application file for complete search history.

(56) References Cited

U.S. PATENT DOCUMENTS

| | | | | |
|---|---|---|---|---|
| 5,116,191 | A * | 5/1992 | Van | B65D 71/0096 414/789.5 |
| 7,007,802 | B1 * | 3/2006 | Moorman | B65D 5/4295 206/521.1 |
| 8,205,787 | B2 * | 6/2012 | Panduro, Jr. | B65D 5/6629 229/173 |
| 9,926,127 | B2 * | 3/2018 | Grinwald | B65D 81/056 |
| 2003/0146272 | A1 * | 8/2003 | Kent | B65D 21/0235 206/509 |
| 2017/0341801 | A1 * | 11/2017 | Carman | B65D 5/4295 |
| 2024/0228104 | A1 * | 7/2024 | Couture | B65D 5/0015 |

* cited by examiner

*Primary Examiner* — Christopher R Demeree
(74) *Attorney, Agent, or Firm* — Dickinson Wright PLLC; Kristopher Lance Anderson

(57) ABSTRACT

A container for storing and displaying produce including a first pair of sidewalls, a second pair of sidewalls connected to the first pair of sidewalls, and a bottom wall extending between the first and second pair of sidewalls to form a receptacle to receive the produce. The first pair of sidewalls each including a top edge portion provided with a first stacking tab extending away from the bottom wall, the bottom wall defining a first stacking aperture, the first tab having a first dimensional characteristic, the stacking aperture having a second dimensional characteristic such that the first stacking aperture is configured to receive a number of stacking tabs, the number of stacking tabs including the first stacking tab and each stacking tab of the number of stacking tabs having the first dimensional characteristic.

15 Claims, 19 Drawing Sheets

AIR STACKING PRODUCE CONTAINER

CROSS-REFERENCE TO RELATED APPLICATIONS

This application is a Utility application which claims benefit and priority to U.S. Provisional Patent Application Ser. No. 63/494,427, filed Apr. 5, 2023, entitled "AIR STACKING PRODUCE CONTAINER," and which patent application is commonly owned by the owner of the present invention. This patent application is hereby incorporated by reference in its entirety for all purposes.

TECHNICAL FIELD

The present disclosure relates to a container or a system of containers used to transport and display produce.

BACKGROUND

Fresh produce may be packaged into containers for transportation from the source of the produce to retail establishments. Certain retailers, such as large box stores, may display the fresh produce in the same containers in which the fresh produce was delivered to avoid expending cost and time associated with unpacking the fresh produce for display. Certain types of produce require packaging configured to provide a suitable environment (e.g., air flow) to facilitate a more uniform and controlled progression of the ripeness and color of the produce.

SUMMARY

According to one embodiment, a container configured to store and display produce is provided. The container may include a first and second pair of sidewalls and a bottom wall. The second pair of sidewalls may be connected to the first pair of sidewalls and the bottom wall to form a receptacle configured to receive the produce. The first pair of sidewalls may each include a top edge portion provided with a first stacking tab extending away from the bottom wall, the bottom wall defining a first stacking aperture, the first tab having a first dimensional characteristic, the stacking aperture having a second dimensional characteristic such that the first stacking aperture is configured to receive a number of stacking tabs, the number of stacking tabs including the first stacking tab and each stacking tab of the number of stacking tabs having the first dimensional characteristic.

According to another embodiment, a container arrangement is provided. The container arrangement may be configured to be arranged in a stacked configuration including a first row of containers of the number of containers and a second row of containers of the number of containers disposed on top of the first row of containers. Each container of the number of containers having a first pair of sidewalls, a second pair of sidewalls, a bottom wall extending between the first and second pair of sidewalls, and a number of stacking tabs each extending from a top portion of the first pair of sidewalls. Each sidewall of the first pair of sidewalls may have a first length and each sidewall of the second pair of sidewalls may have a second length, the first length may be greater than the second length. The bottom wall may define a first stacking aperture. The first row of containers may include a first container and a second container that may disposed adjacent to the first container. The first pair of sidewalls of the first and second containers may extend along a first direction, so that at least one stacking tab of the first container is adjacent to at least one stacking tab of the second container. The second row of containers may include a third container, the second pair of sidewalls of the third container extending along the first direction, and the at least one stacking tab of the first container and the at least one stacking tab of the second container may be received by the first stacking aperture of the third container.

DETAILED DESCRIPTION

Figures 1A, 1B:
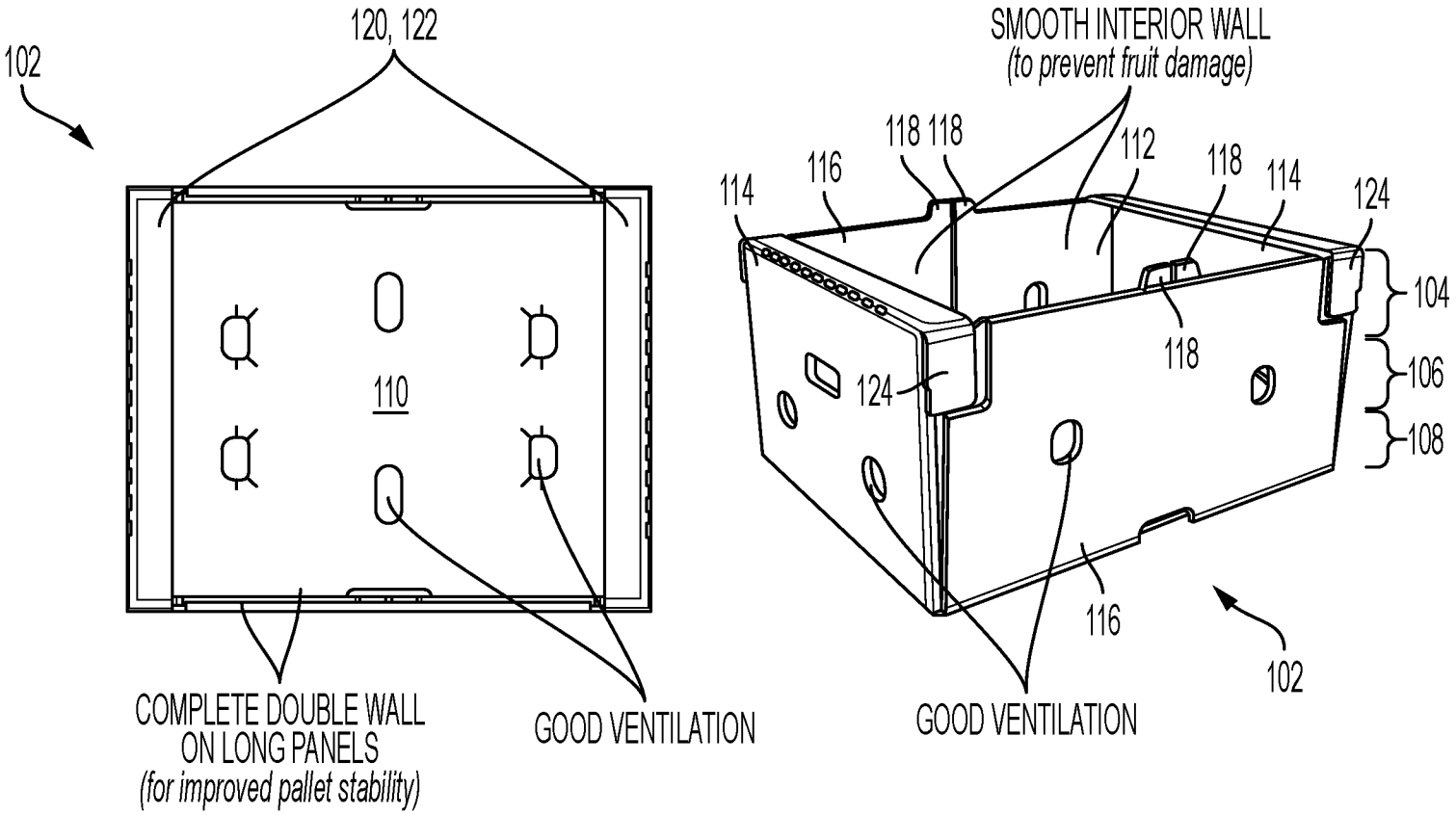
FIGS. 1A-1C illustrate a top view, a top-perspective view, and a bottom perspective view of an exemplary produce container.
Figure 1C:
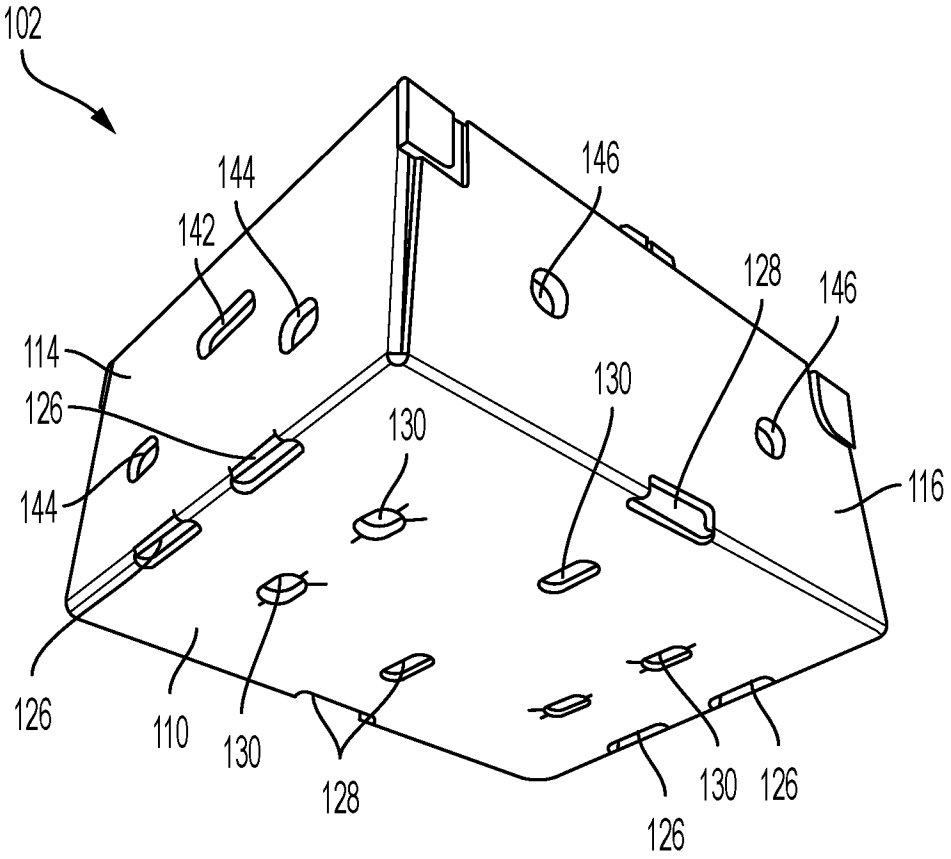

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Fresh produce (e.g., bananas) may be packaged into containers after harvesting for transportation from the source to a retailer, distributor, or another entity within the supply chain. The containers may be placed (e.g., stacked) on top of one another so that full pallets may be used to transport the produce. Certain retailers (e.g, large-box stores) may display the fresh produce in the same containers in which the fresh produce was delivered to avoid expending cost and time associated with repackaging the fresh produce for display. These containers generally have an open top so that the produce may be displayed and easily accessible at the retailers. Some types of produce may generate heat as part of the ripening process, and often such containers include apertures (e.g., holes or slots) to facilitate dissipation of the heat produced by the produce. Due to the size and placement of such apertures as well as the length and width of the containers, the containers may not be readily configured for stacking and restacking the containers for transport and display while maintaining the require heat dissipation properties.

The present disclosure attempts to address one or more of the foregoing challenges.

As used in the specification and the appended claims, the singular form "a," "an," and "the" comprise plural referents unless the context clearly indicates otherwise. For example, reference to a component in the singular is intended to comprise a plurality of components.

The term "substantially" or "about" may be used herein to describe disclosed or claimed embodiments. The term "substantially" or "about" may modify a value or relative characteristic disclosed or claimed in the present disclosure. In such instances, "substantially" or "about" may signify that the value or relative characteristic it modifies is within #0%, 0.1%, 0.5%, 1%, 2%, 3%, 4%, 5% or 10% of the value or relative characteristic.

The term "detachably connected" or "detachably fixed" may be used herein to describe disclosed or claimed embodiments. The term "detachably connected" or "detachably fixed" may refer to two elements that may be selectively connected or fixed to one another and disconnected to unattached from one another without permanently deforming or damaging the first element, the second element, or both.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). The term "and/or" may include any and all combinations of one or more of the associated listed items.

Although the terms first, second, third, etc. may be used to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Referring generally to the figures, a produce container arrangement 100 is provided. The produce container arrangement may be configured to store produce during transportation and display the produce for sale. The produce container arrangement 100 may include a number of produce containers 102 that may be substantially identical to one another in size and shape (e.g., rectangular) though other configurations may be readily contemplated. The container 102 may include a top portion 104, that may be at least partially open to provide access to an interior 112 of the container as well as ventilation or communication of air between each of the containers 102, a bottom portion 108, that may include a bottom wall 110, and a medial portion 106 extending between the top and bottom portions 104, 108.

A number of sidewalls (e.g., four) may be connected to the bottom wall 110 and form the top, bottom, and medial portions 104-108 of the container 102. As an example, the sidewalls may include a pair of lateral sidewalls 114 and a pair of longitudinal sidewalls 116 that may be longer than each of the pair of lateral sidewalls 114. One or more (e.g., two) stacking tabs 118 may extend from portions (e.g., the top portion 104) one or more of the sidewalls 114,116 (e.g., the longitudinal sidewalls 116). As an example, one or of the stacking tabs 118 may include a free or distal end 118*a* and a bottom portion 118*b*, and the one or more stacking tabs 118 may taper from the bottom portion 118*b* to the top portion 118*a*. The top portion 104 of one or more of the sidewalls (e.g., lateral sidewalls 114) may include a supporting flange or flap 120 that may include a main portion 1122 and one or more lateral support members 124 that may extend from the main portion 122 and folded over and connected (e.g., adhered) to each of the longitudinal sidewalls 116. The flange 120 may be configured to support other containers 102 when the containers 102 are arranged in one or more stacked configurations.

The bottom portion 108 of the container 102 may include a number of stacking apertures (e.g., slots or openings) that may be configured to receive one or more of the stacking tabs 118 when the containers 102 are arranged in the stacked configurations so that the containers 102 are detachably connected to one another. One or more of the stacking slots may also be configured to vent air from the interior portion 112 of the container to the surrounding environment. The number of stacking slots may vary in size, shape and position as required for the purposes of stacking and ventilation. As an example, stacking slots may include lateral edge slots 126, longitudinal edge slots 128, and bottom wall slots 130.

The lateral edge slots 126 may be defined by the bottom wall 110 and positioned adjacent to each of the lateral sidewalls 114. As an example, one or more (e.g., two) lateral edge slots 126 may be positioned adjacent to each of the lateral sidewalls 114 and spaced apart from the longitudinal sidewalls 116 and from a midpoint of the lateral sidewalls 114 so that they are positioned to receive one or more of the stacking tabs 118. In one or more embodiments, the longitudinal edge slots 128 may include a first portion 128*a*, that may be formed by the bottom wall 110, and a second portion 128*b* that may be formed by the longitudinal sidewall 116. As an example, the longitudinal edge slots 128 may be disposed at a midpoint or center of the bottom wall 110 where the bottom wall 110 joins each of the longitudinal sidewalls 116.

A number of bottom wall slots 130 (e.g., four) may be formed by the bottom wall 110. Each of the bottom wall slots 130 may be spaced apart from the lateral sidewalls 114 and the longitudinal sidewalls 116. The bottom wall slots 130 may define a peripheral edge formed by a pair of longitudinal edge regions 132, a pair of lateral edge regions 134, and one or more (e.g., four) corner edge regions 136 that may connect the pair of longitudinal edge regions 132 to the pair of lateral edge regions 134. A number of pre-cut openings or slits 138, 140 may radially extend from the edge regions 132-136 so that one or more of the slits 138, 140 may receive one or more of the stacking tabs 118 when the containers 102 are disposed in one or more of the stacked configurations. The slits 140 may be configured to selectively weaken the area surrounding the bottom wall slots 130 so that area is relatively flexible and configured to bend so that the bottom wall slots 130 may receive one or more (e.g., four) stacking tabs 118.

The stacked configurations may include an aligned configuration, in which an outer periphery of the container 102 (e.g., formed by the sidewalls 114, 116) is substantially aligned with or contacting an outer periphery of another container 102. The stacked configuration may also include an offset configuration, in which at least a portion of the outer periphery of one container 102 is offset from an outer periphery of another container 102. As one example of an offset configuration, in which a first container 102 is disposed below a second container 102', the lateral sidewalls 114 of the first container 102 may be arranged to extend in a first direction D1 and the lateral sidewalls 114' of the second container 102' may be arranged to extend in a second direction D2, which may be substantially orthogonal to the first direction D1.

In one or more embodiments, the sidewalls 114, 116 may include a number of apertures or openings that may provide one or more functions. The lateral sidewalls 114 may each include a handle opening 142 that may be in the shape of an elongated slot sufficiently sized for a user to grasp the container 102 so that the container 102 may be picked up or repositioned. As an example, the handle opening 142 may be positioned in the medial portion 106 of the container and about a midpoint of the lateral sidewall 114. The lateral sidewalls 114 may also define one or more lateral vents 144 that may be positioned within the medial portion 106 and disposed on each side of the handle opening 142. Additionally or alternatively, the longitudinal sidewalls 116 may define one or more (e.g., two) longitudinal vents 146 that may be positioned within the medial portion 106. The lateral vents 144 and the longitudinal vents 146 may each be configured to facilitate air flow from the interior portion 112 of the container 102 to the surrounding environment.

Figure 2:
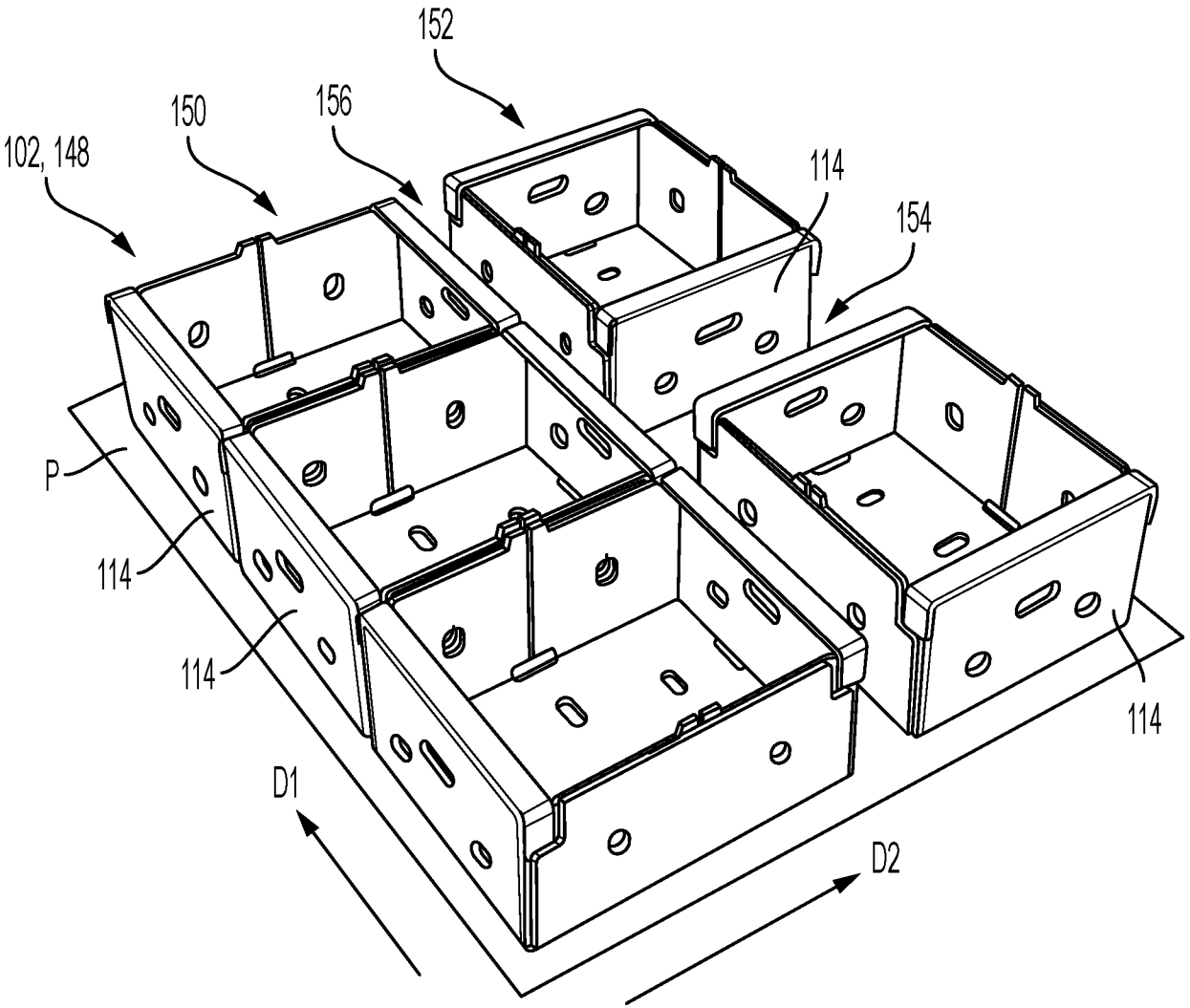
FIG. 2 illustrates a top-perspective view of a number of produce containers arranged in two horizontal rows.
Figure 3:
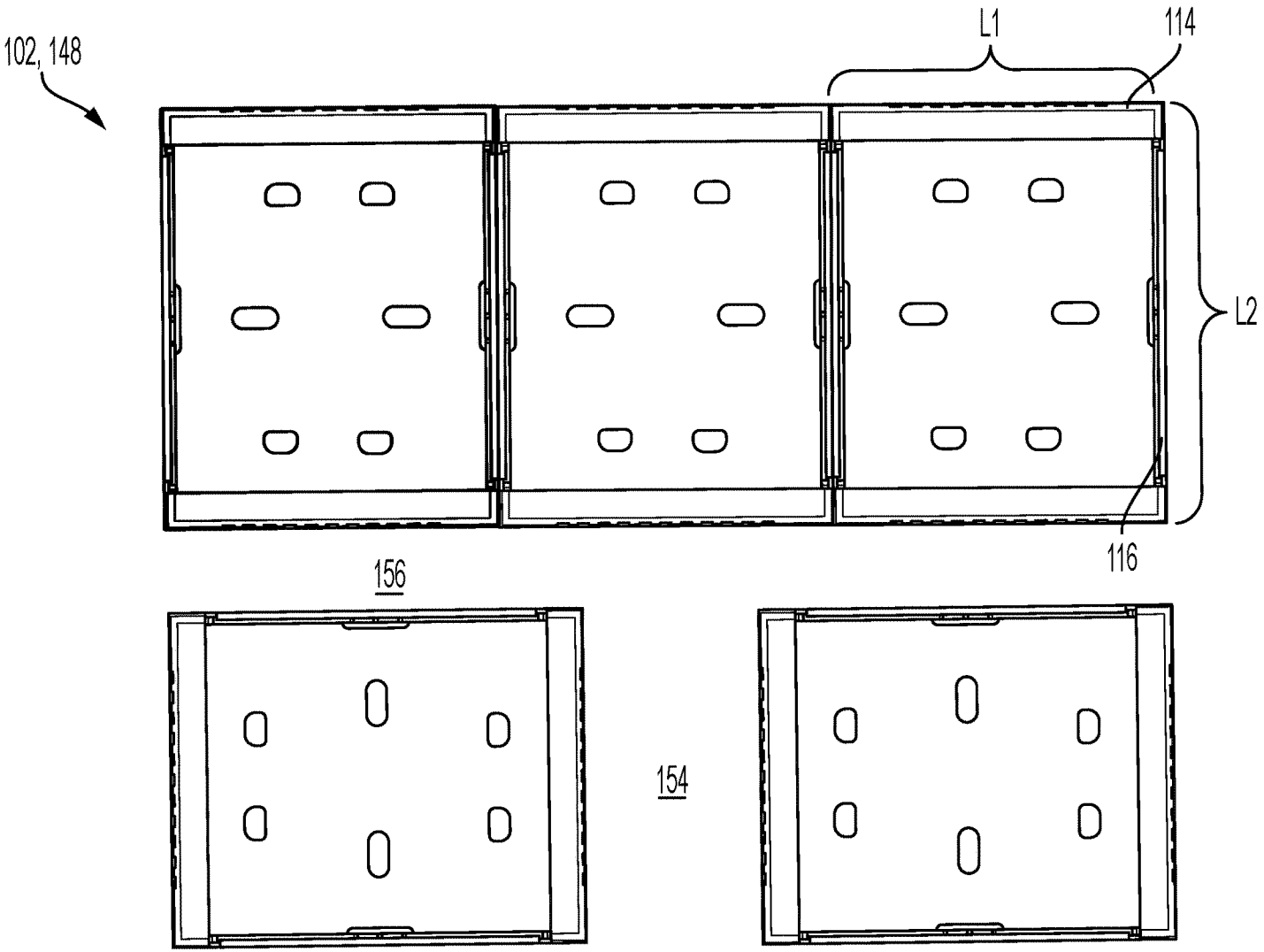
FIG. 3 illustrates a top view of the number of produce containers illustrated in FIG. 2.
Figure 4A:
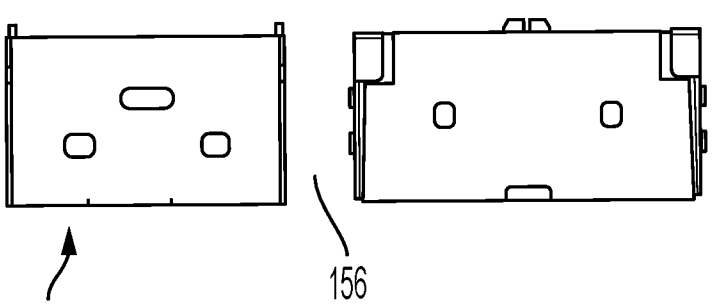
FIGS. 4A-4D illustrate plan views of the number of produce containers illustrated in FIG. 2.
Figure 4B:
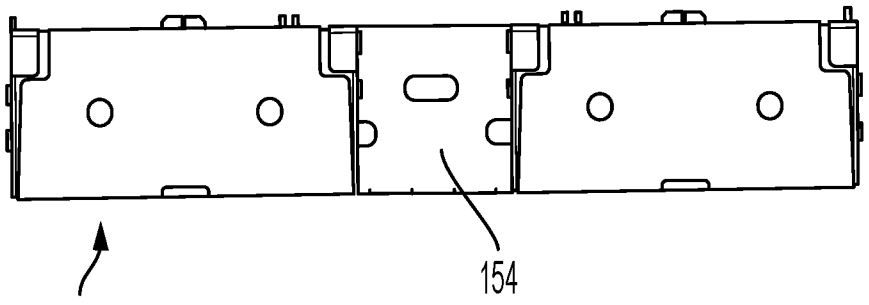
Figure 4C:
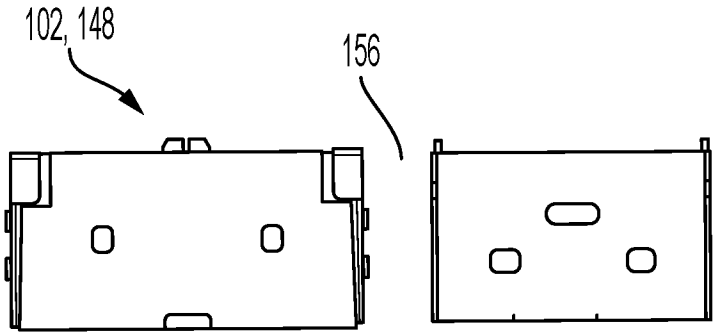
Figure 4D:
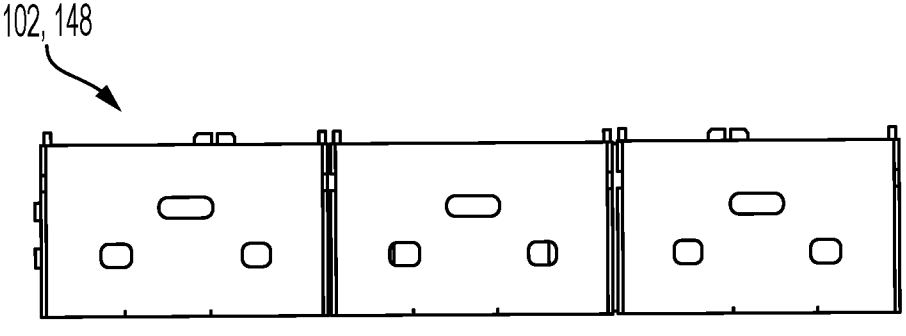

FIG. 2 illustrates a perspective view and FIG. 3 illustrates a top view of a first row 148 of containers 102 disposed on a pallet P. As stated above, the containers 102 may have a substantially rectangular shape, and as an example, the lateral sidewall 114 may have a first length L1 and the longitudinal sidewall 116 may have a second length L2 that may be greater than the first length L1. The first row 148 may include a first section 150 and a second section 152. The first section may include a number of containers 102 (e.g., three) arranged so that the lateral sidewalls 114 extend in a first direction D1 and the second section 152 may include a number of containers 102 (e.g., two) arranged so that the lateral sidewalls 114 extend in a second direction D2. The first and second directions D1, D2 may be substantially orthogonal to one another.

FIGS. 4A-4D illustrate plan views of the first row 148 of the containers 102 as illustrated in FIG. 2. The containers 102 in the second section 152 may be spaced apart from one another to form a first air channel 154 and the first section 150 and the second section 152 may be spaced apart from one another to form a second air channel 156. The first and second air channels 154, 156 may each be configured to receive air from the lateral and longitudinal vents 144, 146 and allow the air to be vented to surrounding areas of the first row 148 of containers 102.

Figure 5B:
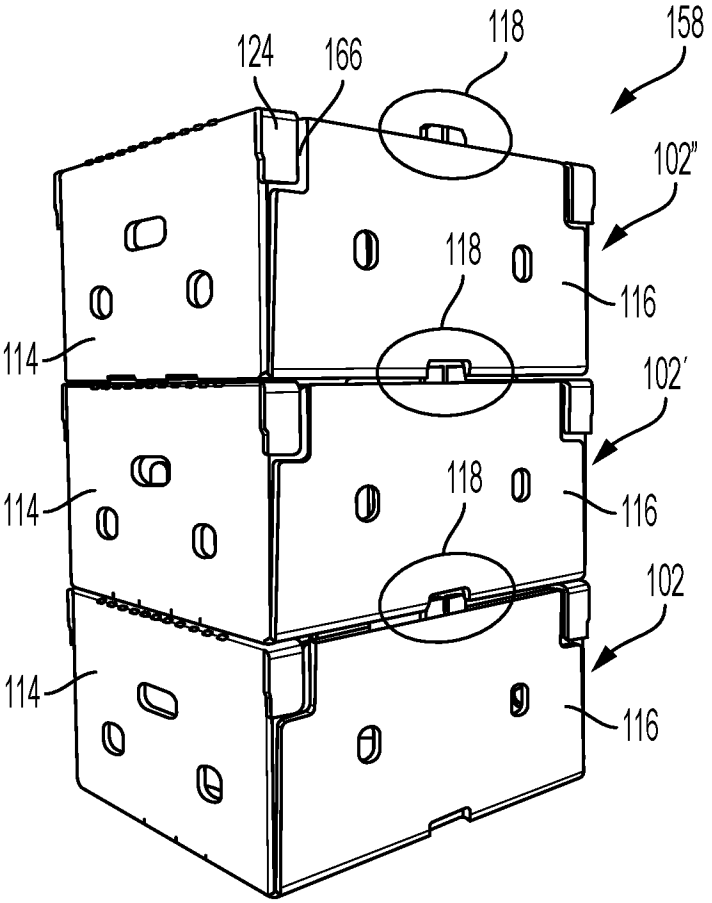
FIGS. 5A-5B illustrate perspective views of a number of produce containers arranged in an aligned stacked configuration
Figure 5A:
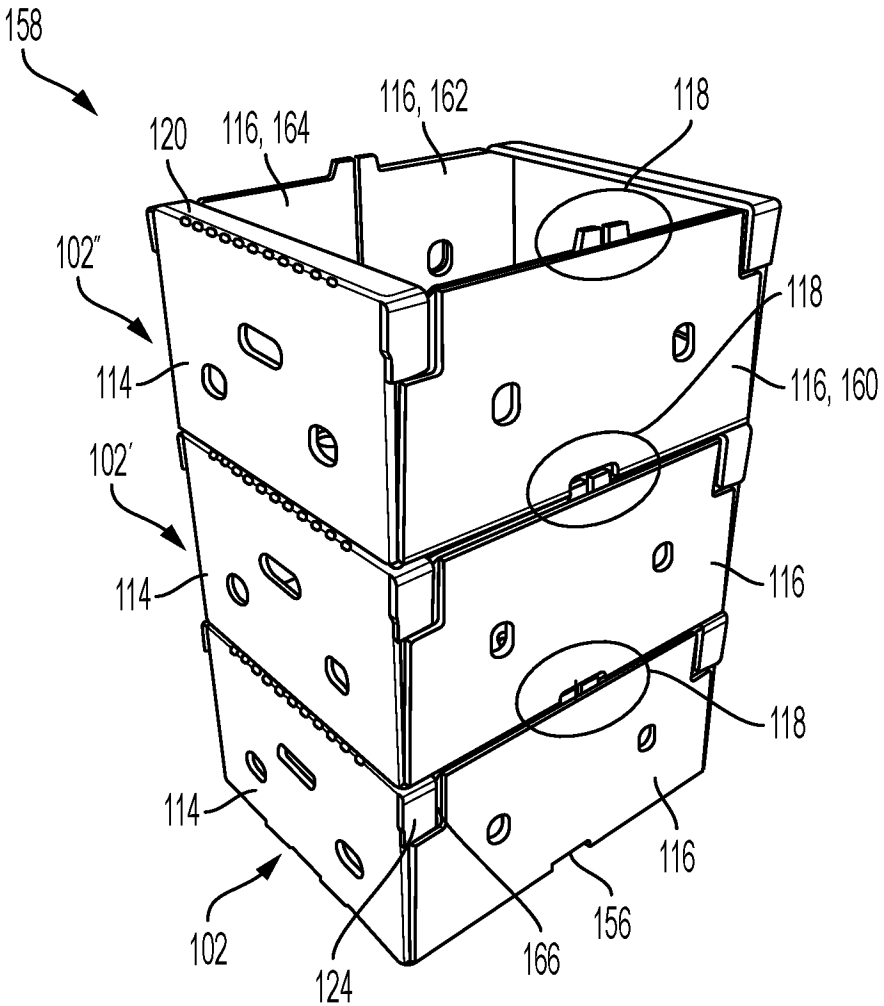

FIG. 5A and FIG. 5B each illustrate a perspective view of the containers 102 arranged in the aligned stacked configuration to form an aligned column 158. While each of the containers may be substantially identical to one another, for purposes of clarity, first, second, and third containers are identified by different reference numbers. The first container 102 may be positioned below a second container 102', and the second container 102' may be disposed a third container 103". As an example, when the containers 102 are aligned stacked configuration, the stacking tabs 118 may inserted into the longitudinal edge slots 128 to detachably connect or fix the first container 102 to the second container 102' and detachably connect the second container 102' to the third container 103'.

In one or more embodiments, the longitudinal walls 116 may be formed by multiple layers so that the longitudinal sidewalls 116 are thicker than the lateral walls 114. To provide the additional thickness, the longitudinal walls 116 may be formed by an outer panel 160 fixed to a first inner panel 162 and a second inner panel 164. The first and second inner panels 162, 164 may extend from the lateral sidewalls 116 and provide additional stiffness by way of the multiple layered longitudinal sidewalls 116. Inner surfaces of the first and second inner panels as well as the inner surfaces of the lateral sidewalls 114 may be substantially planar or smooth so that the interior portion (FIG. 1B) of the containers 102 includes smooth inner surfaces to avoid damaging the produce stored therein. The interior portion 112 may also be referred to as a receptacle. In one or more embodiments, the outer panel 160 of the longitudinal sidewalls 116 may include one or more notches 166 (e.g., two) so that the supporting lateral portions 124 of the flange may be fixed to the first and second inner panels 162, 164.

Figure 6B:
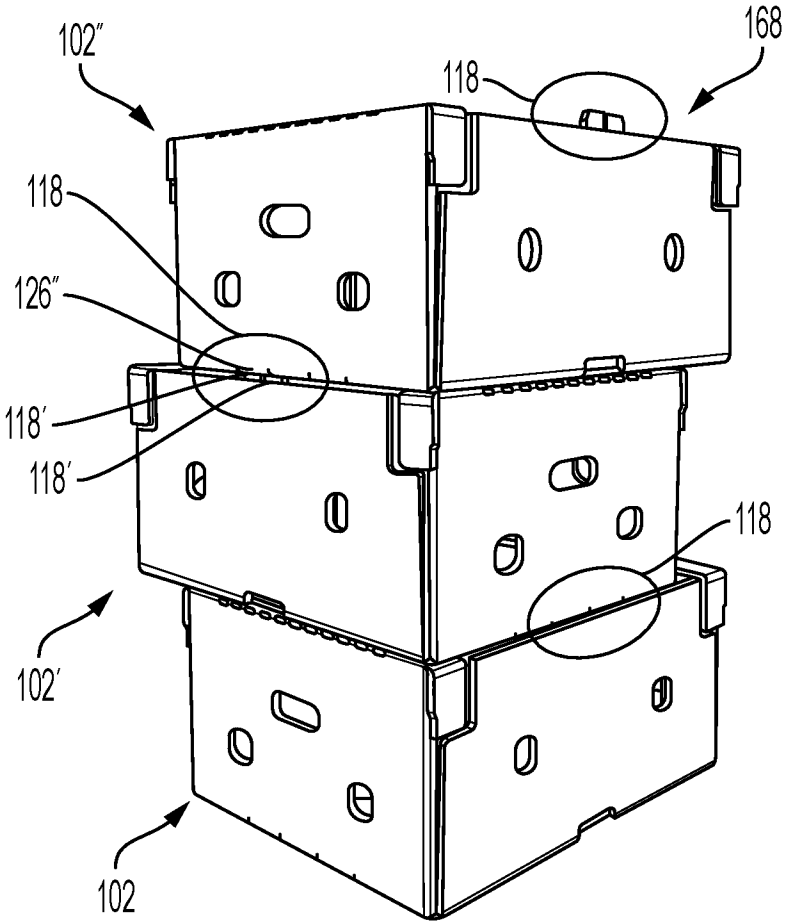
FIGS. 6A-6B illustrate perspective views of a number of produce containers arranged in an offset stacked configuration
Figure 6A:
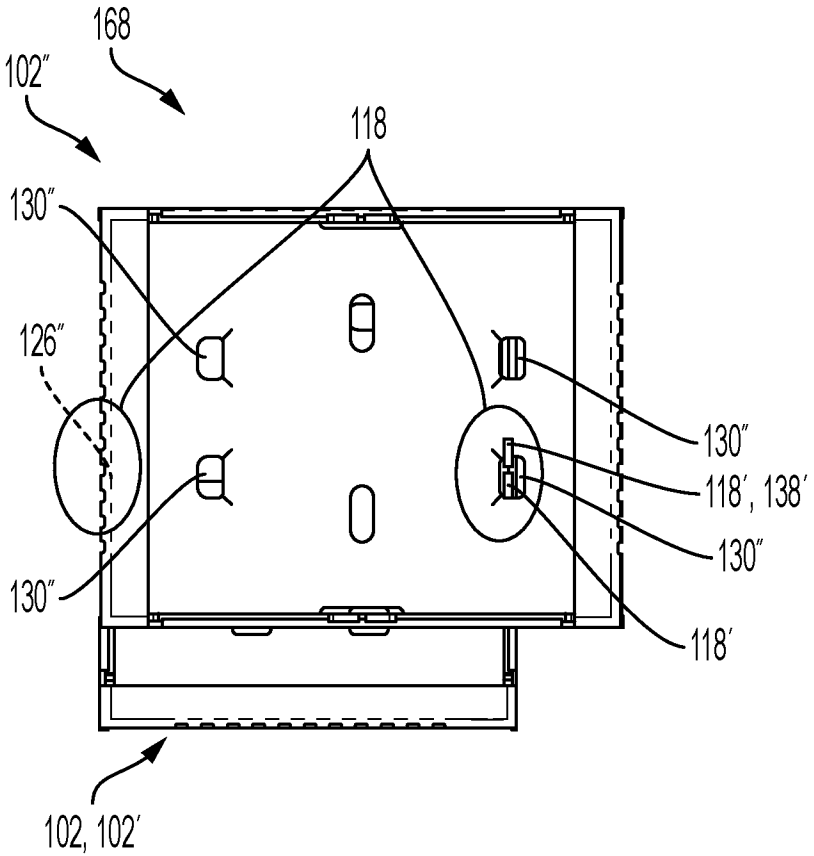

FIG. 6A and FIG. 6B each illustrate a perspective view of the containers 102 arranged in the offset stacked configuration to form an offset column 168. Offset columns 168 may allow the containers to be arranged to provide sufficient space for ventilation, such as by air channels including the first and second air channels 154, 156 (FIG. 2), and for efficient pack density. As illustrated in FIG. 6A, one or more of the stacking tabs 118' (e.g., two) of the second container 102 may extend through one or more of the bottom wall slots 130" and/or one or more of the slits, such as the first slit 138. And as is best illustrated in FIG. 6B, stacking tabs 118', positioned opposite those disposed in the bottom wall slots 130", may extend through the lateral edge slots 126" of the third container 102".

Figure 7:
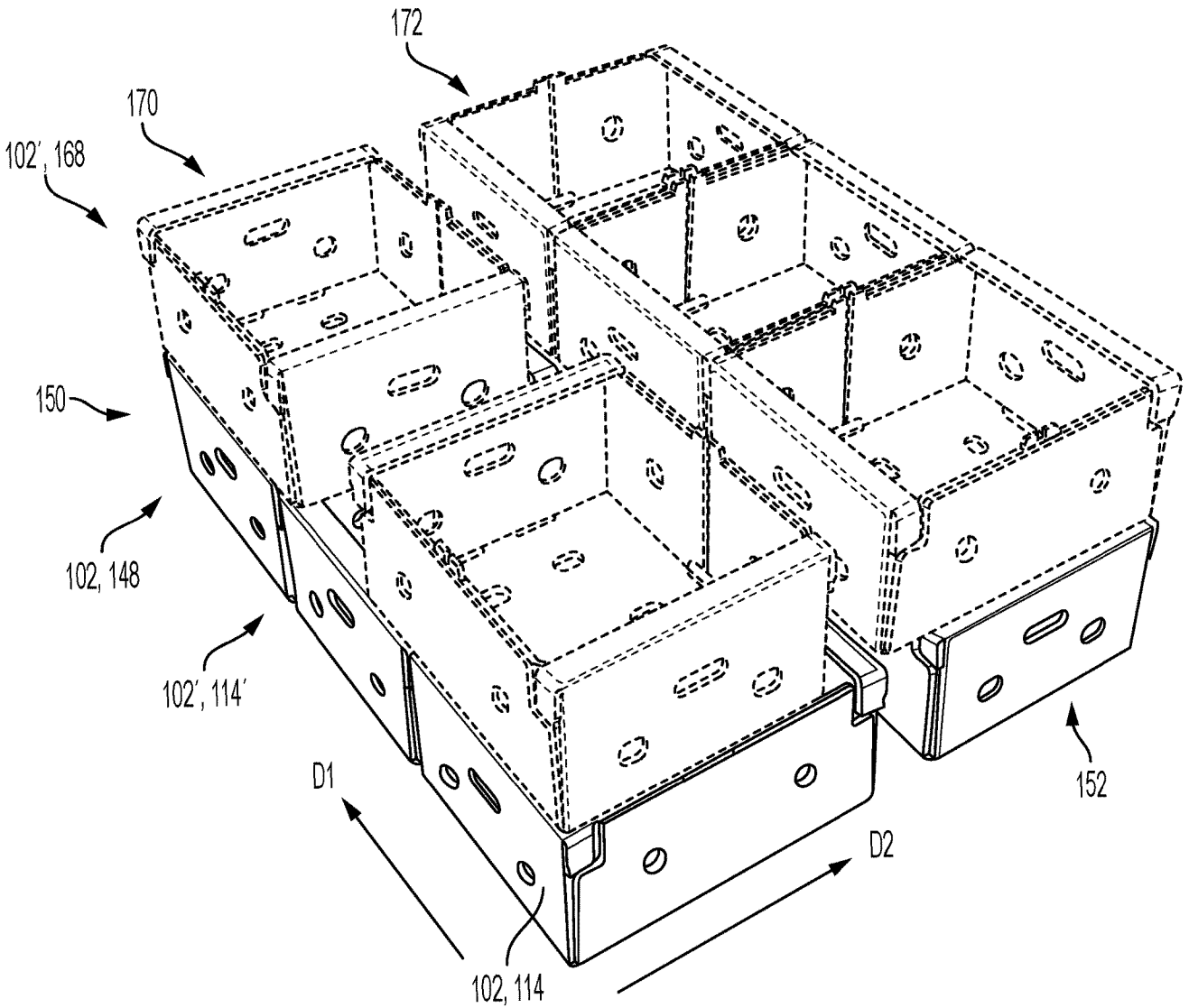
FIG. 7 illustrates a top-perspective view of the number of produce containers arranged in two rows and layers stacked in an offset configuration.
Figure 8:
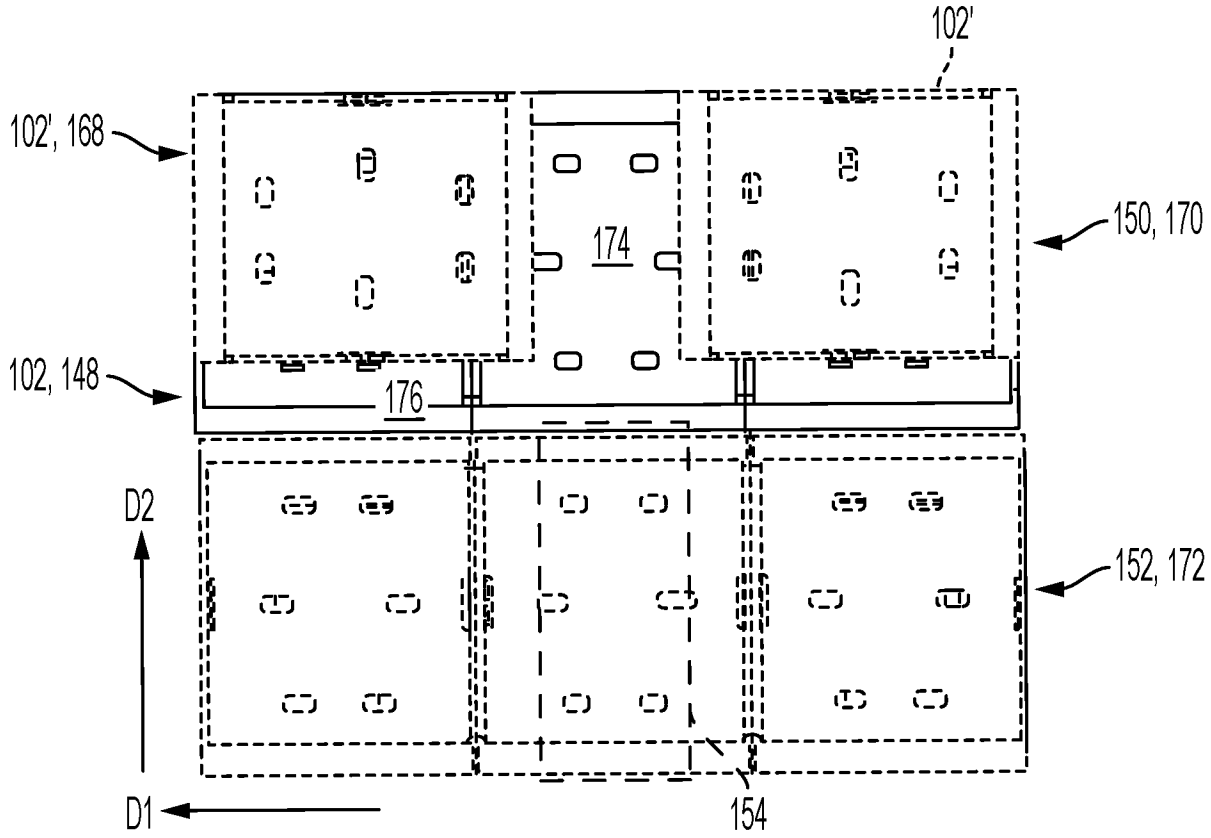
FIG. 8 illustrates a top view of the number of produce containers arranged in horizontal rows and layers stacked in an offset configuration.
Figure 9A:
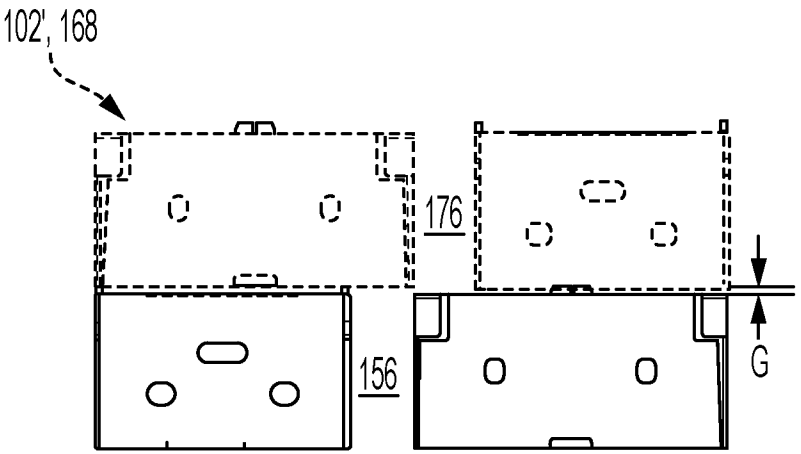
FIGS. 9A-9D illustrate plan views of the number of produce containers illustrated in FIG. 7.
Figure 9B:
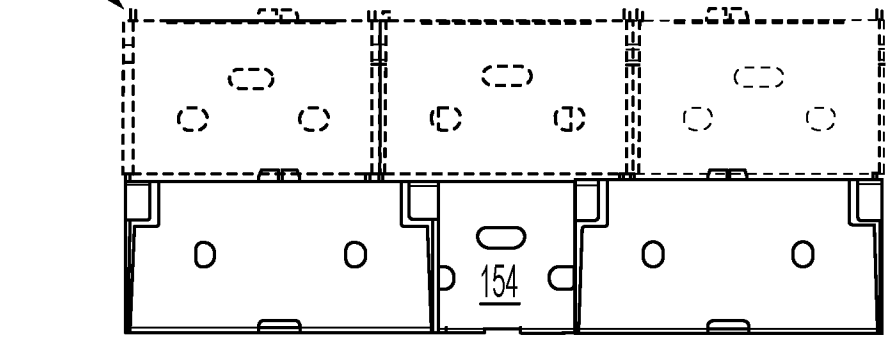
Figure 9C:
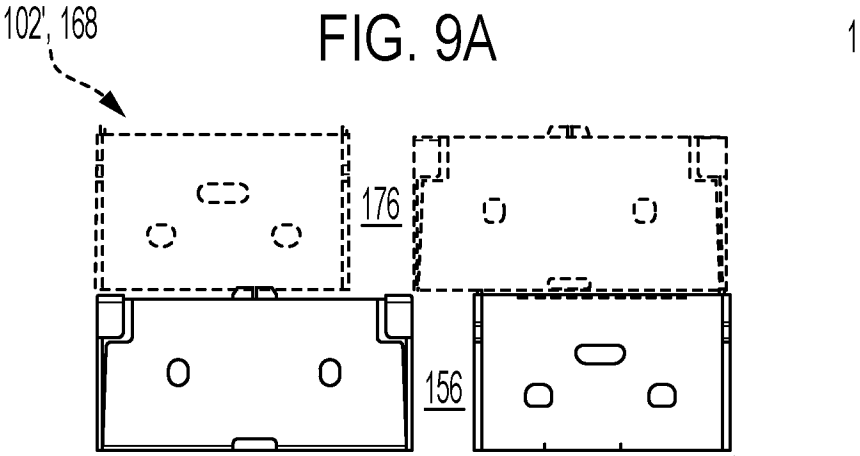
Figure 9D:
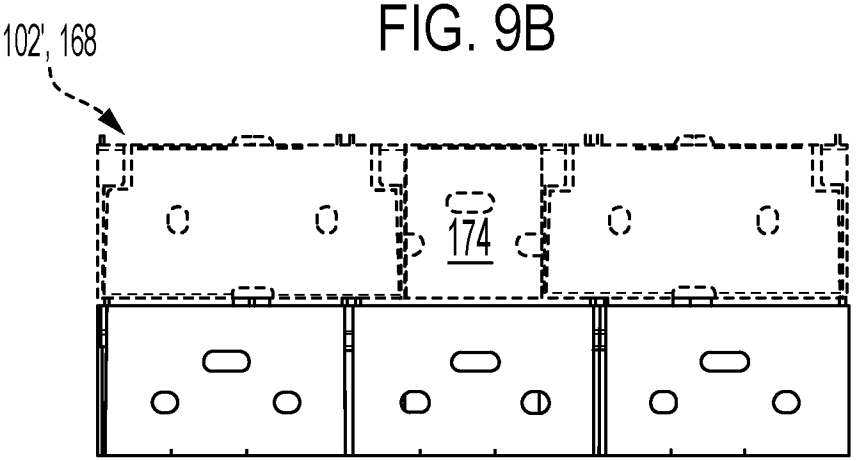

FIG. 7 illustrates a perspective view of the first row 148 and a second row 168 of the containers 102 disposed on top of the first row 148. FIG. 8 and FIGS. 9A-9D illustrate a top view and plan views of the first and second rows 148, 168 of the containers 102 illustrated in FIG. 7. The second row 168 may be divided into a number of sections, such as a first section 170 and a second section 172. While the first section 150 of the first row 148 may include three containers 102 positioned adjacent and contacting one another, the first section 170 of the second row 168 may include two containers 102' that may be spaced apart from one another to form a third air channel 174. The second section 172 of the second row 168 may be spaced apart from the first section 170 of the second row 168 to form a fourth air channel 176 that may be arranged orthogonal to the first air channel 174.

The containers 102 arranged in the first and second rows 148, 168 are illustrated in an empty state, in other words, the containers 102 do not include any produce. Accordingly, the size and shape of the stacking tabs 118 and the slots, including the lateral edge slots 126, longitudinal edge slots 128, and the bottom wall slots 130, may cooperate so that a gap G is formed between the containers 102' of the second row 168 and the containers 102 of the first row 148. As the containers 102' of the second row 168 are filled with produce, the weight of the produce may apply sufficient force to eliminate the gap G. As an example, the stacking tabs 118 of the containers 102 of the first row 148 may engage peripheral edges of one or more of the slots 126, 128, 130 of the containers 102' of the second row 168. As will be described in greater detail below, the stacking tabs 118 may be tapered so that as the gap is eliminated, an interference fit is formed between the stacking tabs 118 and the peripheral edges of the one or more of the slots 126, 128, 130 of the containers 102'. The interference fit may mitigate unintentional movement or shifting of the containers 102' of the second row 168 with respect to the containers 102 of the first row 148.

Figure 10:
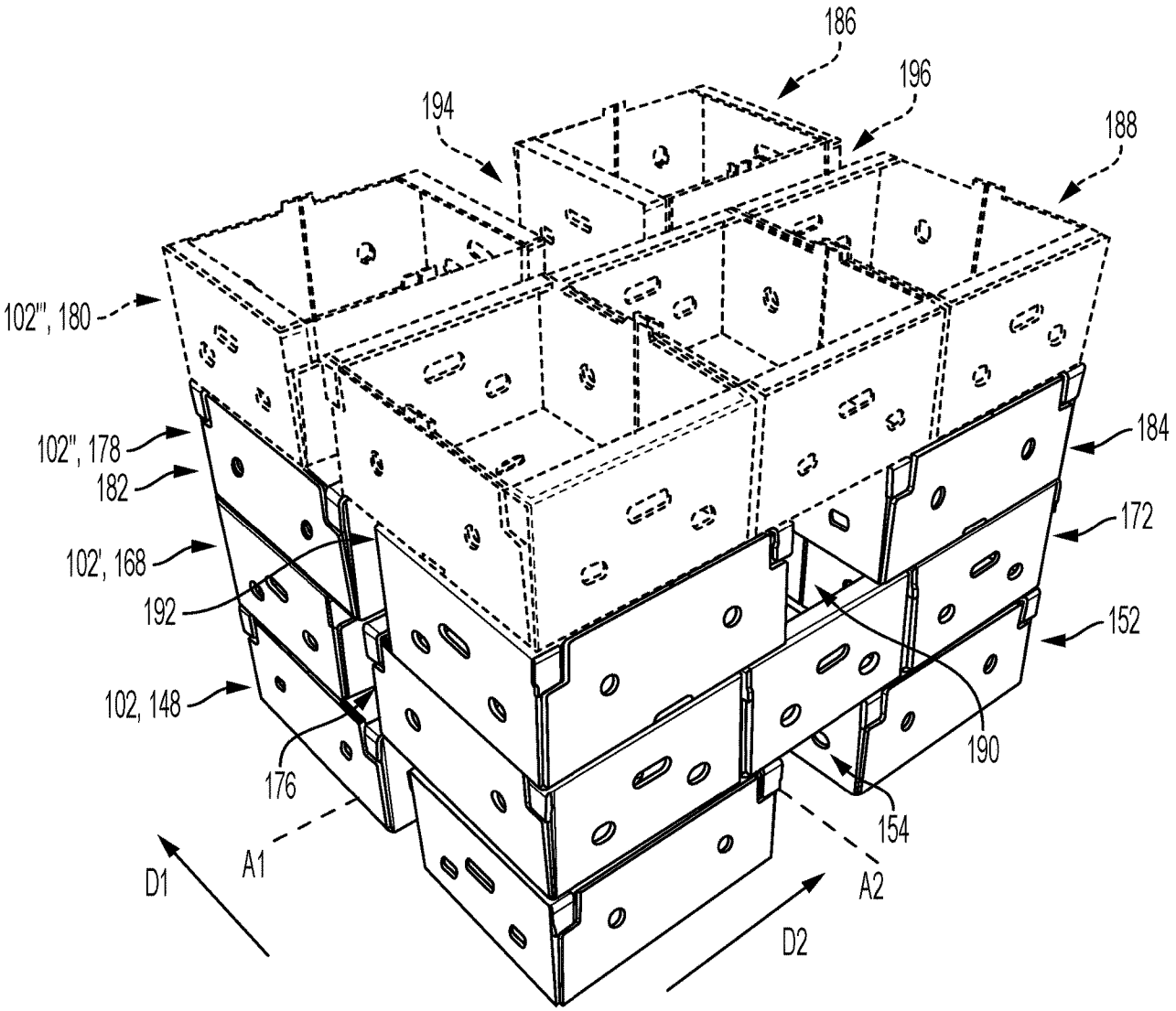
FIG. 10 illustrates a perspective view of a number of produce containers arranged in an offset stacked configuration.
Figure 11A:
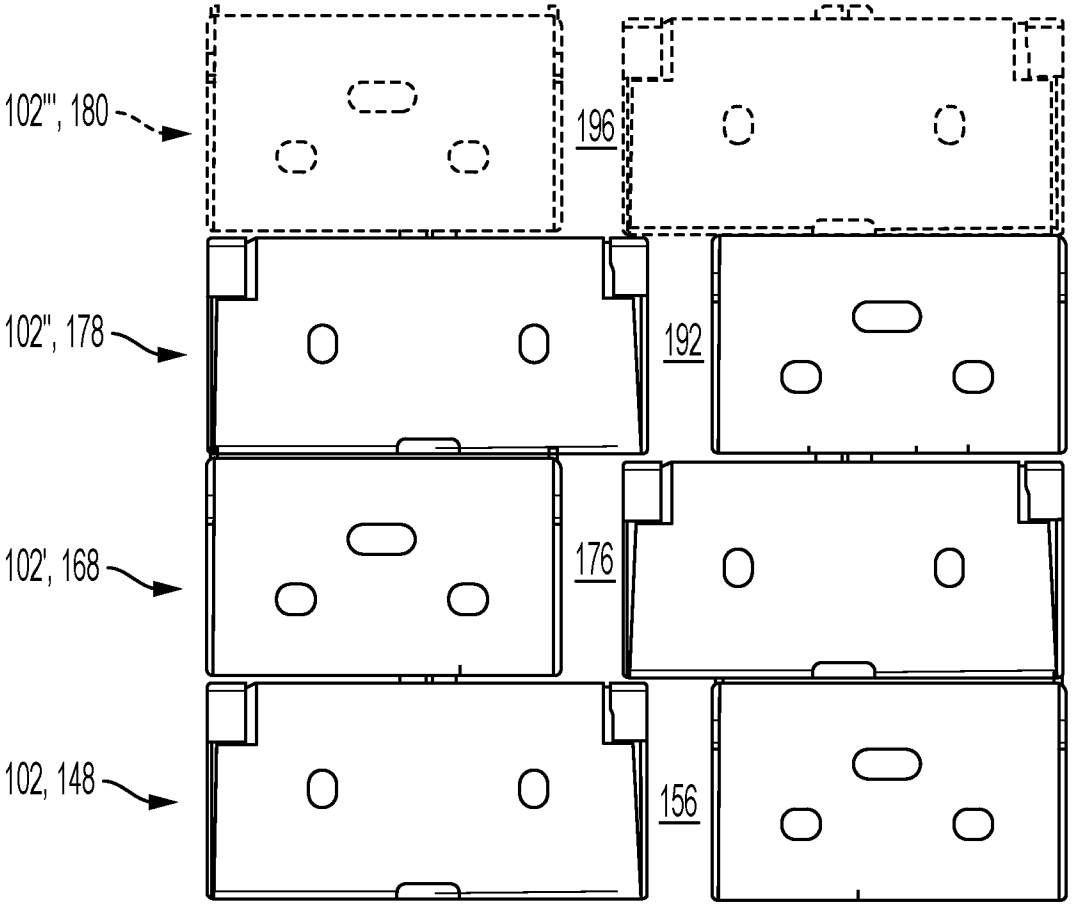
FIGS. 11A-11C illustrate plan views of the number of produce containers illustrated in FIGS. 10A-10B.
Figure 11C:
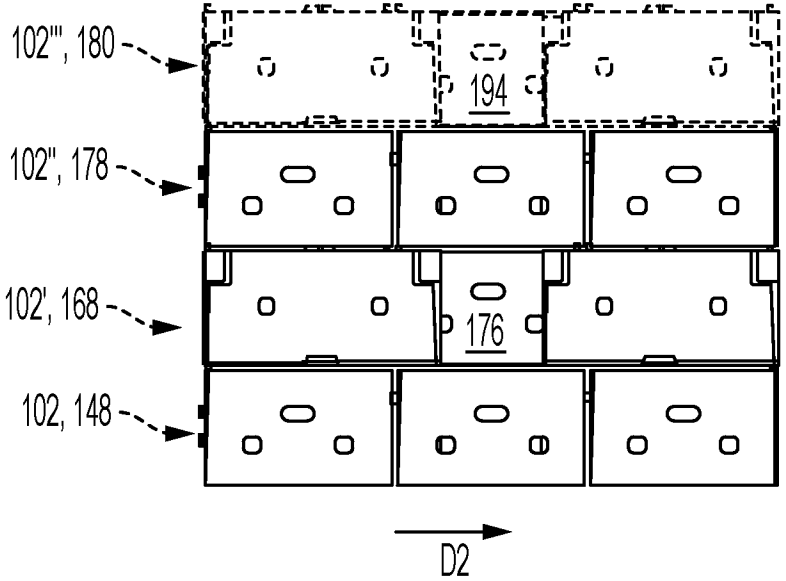
Figure 11B:
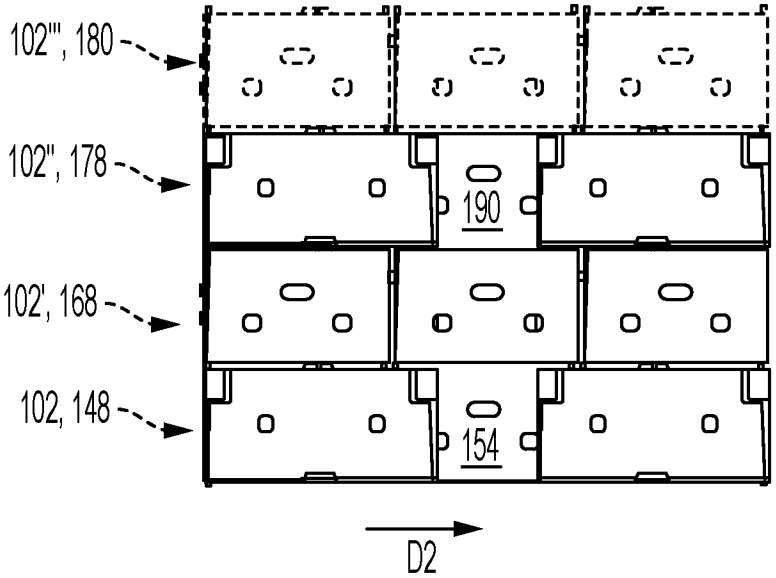

FIG. 10 illustrates a perspective view of the first row 148 of containers 102, a second row 168 of the containers 102', disposed on top of the first row 148, a third row 178 of containers 102" disposed on top of the containers 102' of the second row 168, and a fourth row of containers. FIGS. 11A-11C illustrate plan views of the four rows 148, 168, 178, 180 stacked on top of one another and illustrated in FIGS. 10A-10B. The third row of containers 102" may include a first section 182 and a second section 184 and the fourth row of containers 102'" may include a first section 186 and a second section 188.

In one or more embodiments, the rows of containers in the stacked configuration may be divided or arranged about a longitudinal axis A1 that may extend in the second direction D2 and a lateral axis A2 that may extend in the first direction D1. The first section 182 of the third row 178 disposed on a first side of the axis A1 may include three containers 102" positioned adjacent to and contacting one another and the second section 184 of the third row 178 disposed on the other side of the axis A1 may include two containers 102" that may be spaced apart from one another to from a fifth air channel 190. The first and second sections 182, 184 of the third row 178 may be spaced apart from one another, for example, with respect to the first axis A1, to form a sixth air channel 192. The fourth row 180 of containers 102"" may be arranged to from a seventh air channel 194 and an eighth air channel 196. The seventh air channel 194 may be formed by two containers 102" spaced apart from one another and disposed in the first section 186 of the fourth row 180 and the eighth air channel 196 may be formed between the first and second sections 186, 188 of the fourth row 180.

As is best illustrated in FIG. 11A, the air channel of one row may be offset from the air channel formed by an adjacent row. For example, the second air channel 156 may be offset from the fourth air channel 176 and the sixth air channel 192 may be offset from the fourth air channel 176 and the eighth air channel 196. Similarly, the second air channel 156 may be substantially aligned in the vertical direction with the sixth air channel 192, and the eighth air channel may be substantially aligned in the vertical direction with the fourth air channel 176. As is best illustrated in FIG. 11B, when viewing the containers 102 arranged to extend in the second direction, the air channels 154, 176, 190, 194 may be formed so that they are visible in every other row 148, 168, 178, 180.

Figures 12, 12A:
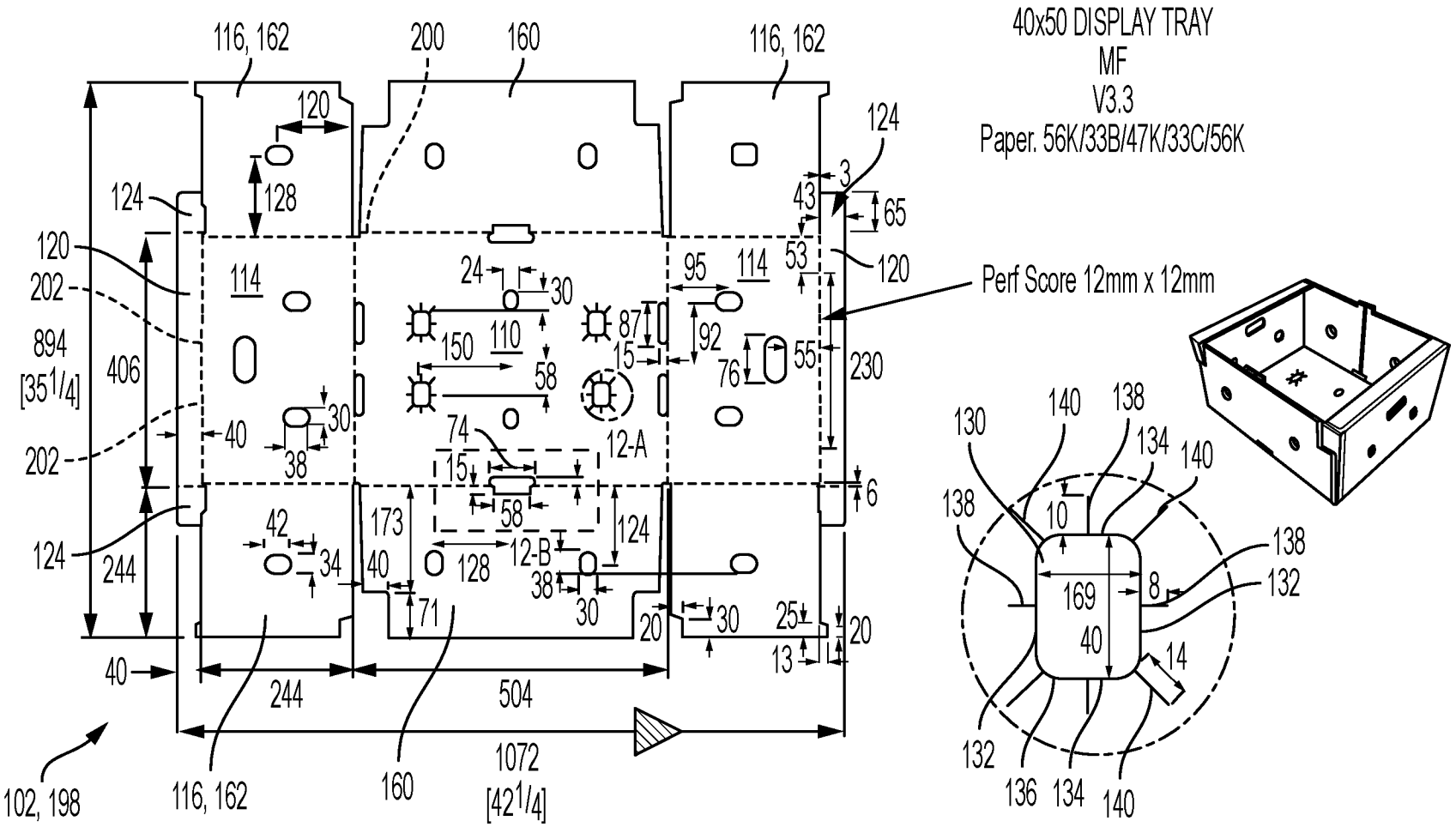
FIG. 12 illustrates a top view of a blank configured to be formed into the exemplary produce container.
FIG. 12A illustrates a detail view taken along the line 12-A in FIG. 12.

FIG. 12 illustrates a blank 198 which may form one or more of the containers 102. The blank may be formed of one or more paper products, such as corrugated cardboard or another material or materials as required. The blank 198 may include a number of creases 200 so that lateral sidewalls 114 and outer panels 160 of the longitudinal walls 116 may be folded with respect to the bottom wall 110 to form the outer periphery of the container 102. Creases 200 may also be provided between the lateral sidewalls 114 and the first and second inner panels 162, 164. Perforations 202 may be provided in one or more portions of the blank 198, such as between each of the flanges 120 and the lateral sidewalls 114.

Figure 12B:
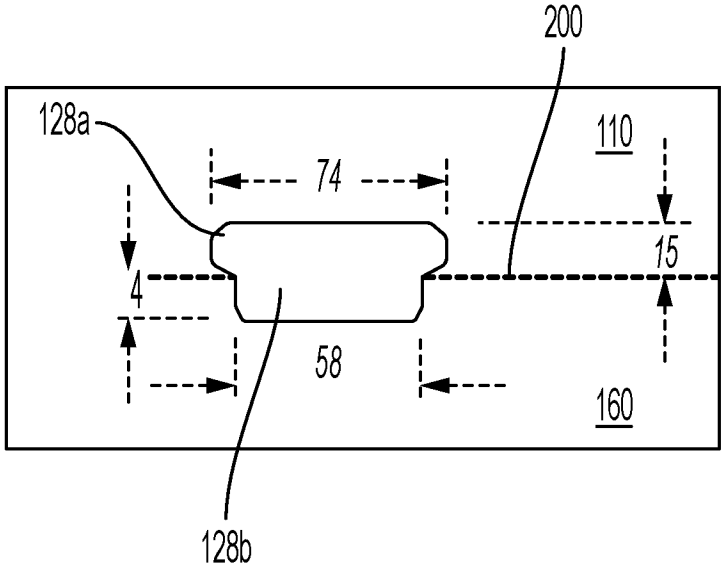
FIG. 12B illustrates a detail view taken along the line 12-B in FIG. 12.

FIG. 12B illustrates a detail view of one of the longitudinal edge slots 128 taken along the lines 12-B in FIG. 12. As mentioned above, the longitudinal edge slot 128 may include a first portion 128*a*, formed by the bottom wall 110, and a second portion 128*b* which may be formed by the outer panel 160. The first portion 128*a* may have a length that is greater than a length of the second portion 128*b*. As an example, the length of the first portion 128*a* may be at least 20% larger than the length of the second portion 128*b*. In one or more embodiments, the width of the first and second portions 128*a*, 128*b* may be substantially equal to one another (e.g., 15 mm).

Figure 13:
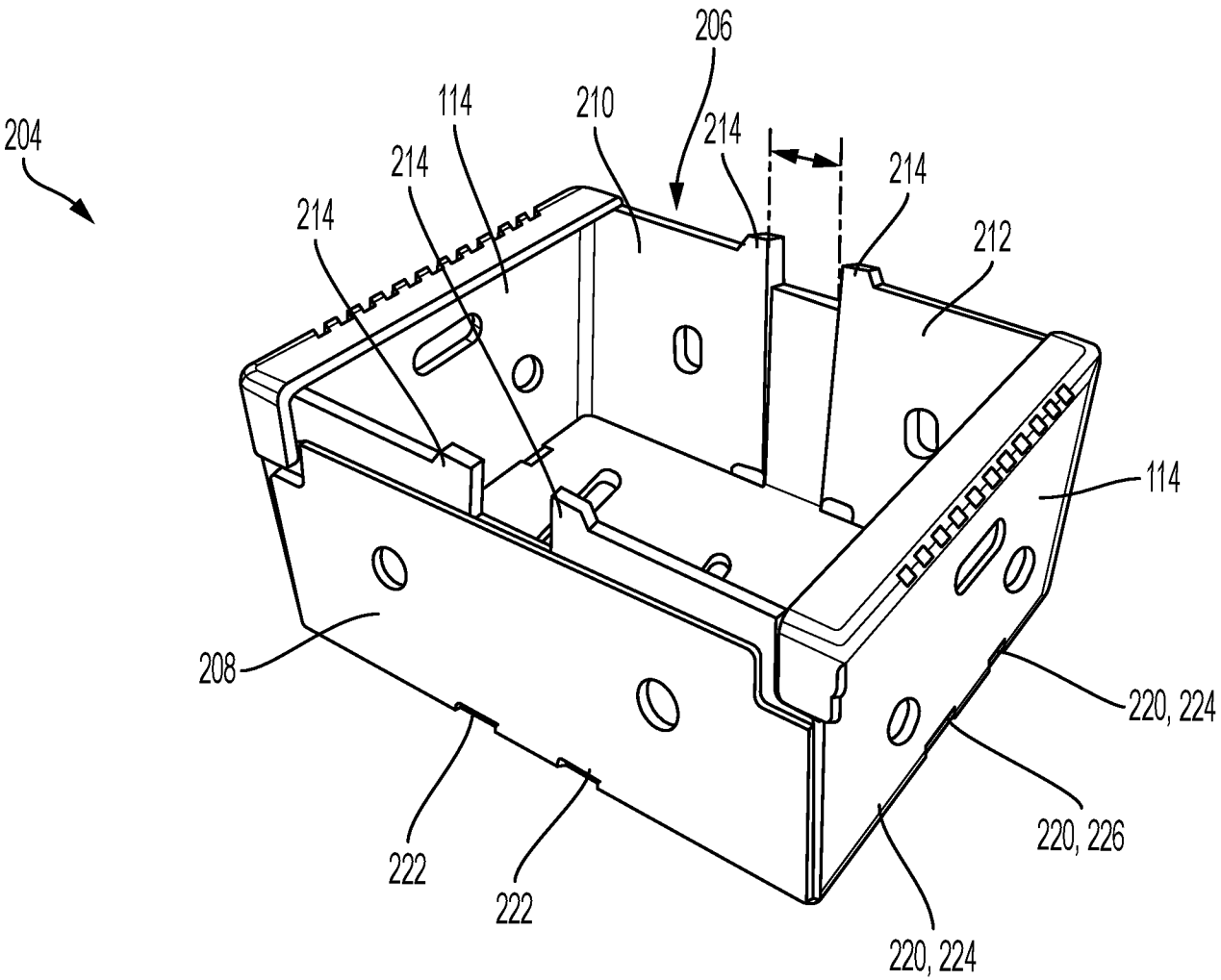
FIG. 13 illustrates a perspective view of another exemplary produce container.
Figures 14, 14A:
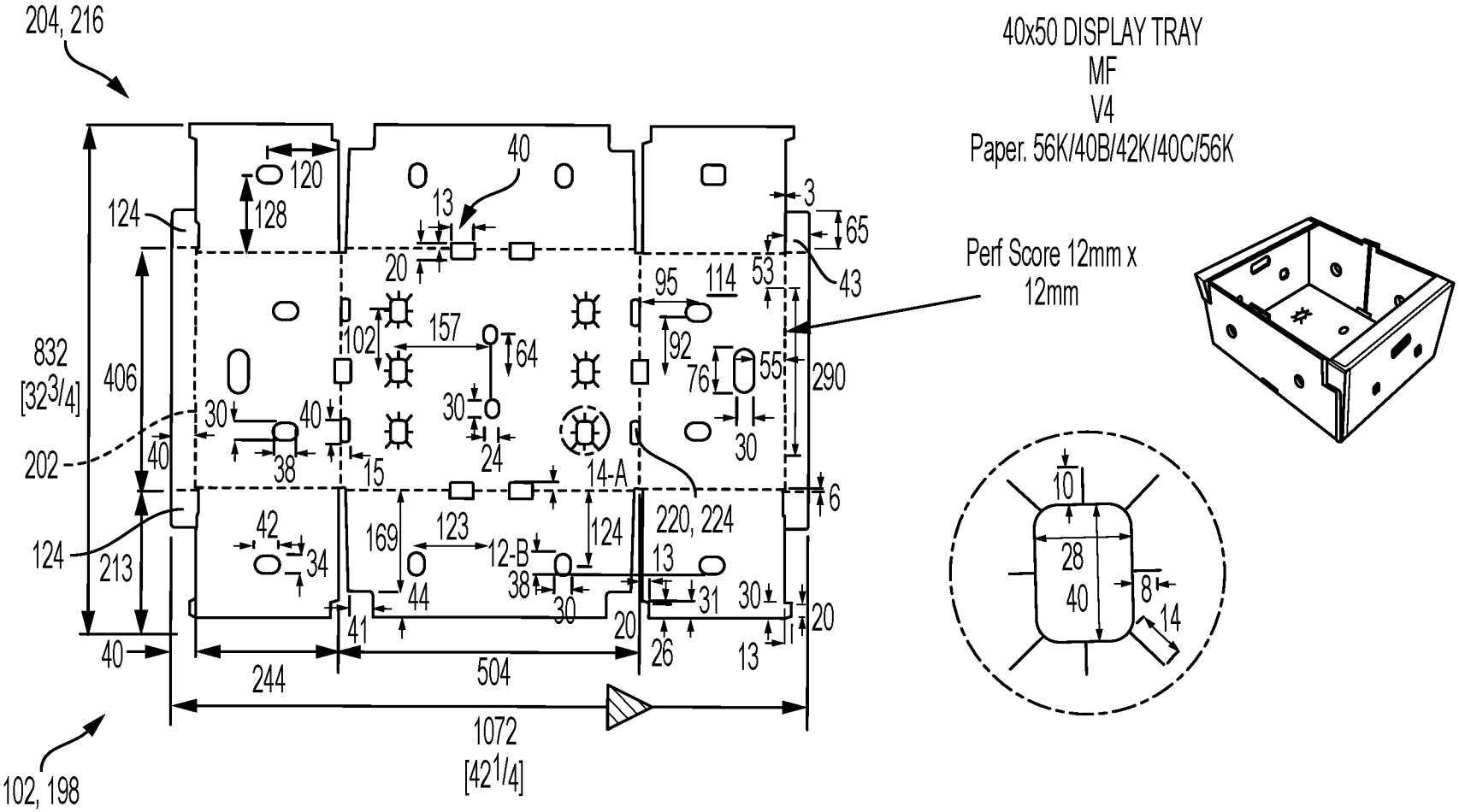
FIG. 14 illustrates a top view of a blank configured to be formed into the exemplary produce container illustrated in FIG. 13.
FIG. 14A illustrates a detail view taken along the line 14-A in FIG. 14.

FIG. 13 illustrates a perspective view of another container 204 according to one or more embodiments. The container 204 may include a number of elements that are similar or identical to those illustrated and described above with reference to the container 102 and elements that are different in size and shape are noted by reference numbers that are different than those elements forming container 102. FIG. 14 illustrates a blank 216 which may form the container 204 and FIG. 14A illustrates a detail view of a bottom wall slot 218 taken along the lines 14-A in FIG. 14.

The container 204 includes longitudinal walls 206 that may extend between the lateral walls 114. Each longitudinal wall 206 may be formed of an outer panel 208 and first and second inner panels 210, 212. In one or more embodiments top edge portions of the inner panels 210, 212 may be spaced apart from the top edge portion of the outer panel 208. In other words, the outer panel 208 may be shorter than one or more of the first and second inner panels 210, 212. End portions of the first and second inner panels 210, 212 may each include a stacking tab 214 that may be sized and positioned to be inserted into one or more of the bottom wall slot 218 (when two containers are arranged in the stacked offset configuration), the lateral edge slot 220, and longitudinal edge slots 222. In one or more embodiments, the lateral edge slots 220 may include an inner edge slot 226 and outer edge slots 224 that may be disposed on either side of the inner edge slot 226. The blank 216 may have a smaller length and width than the blank 198, thereby reducing material costs of the container 204.

FIGS. 12-12A and FIGS. 14-14A each include exemplary dimensions or dimensional characteristics of various features and elements of the containers 102, 204 and are not intended to be limiting in any way.

Figure 15:
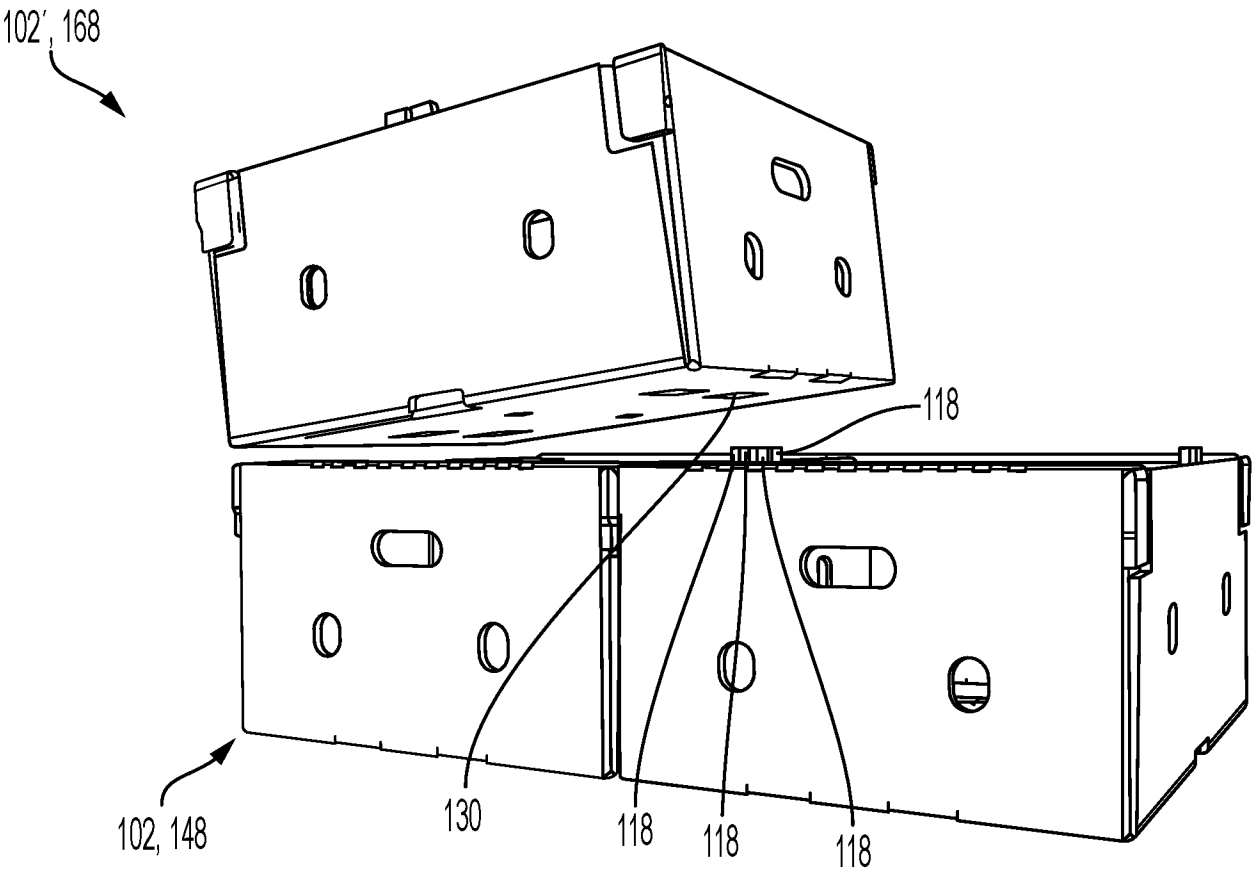
FIG. 15 illustrates a perspective view of a second row container being positioned on top of a pair of first row containers.
Figure 16:
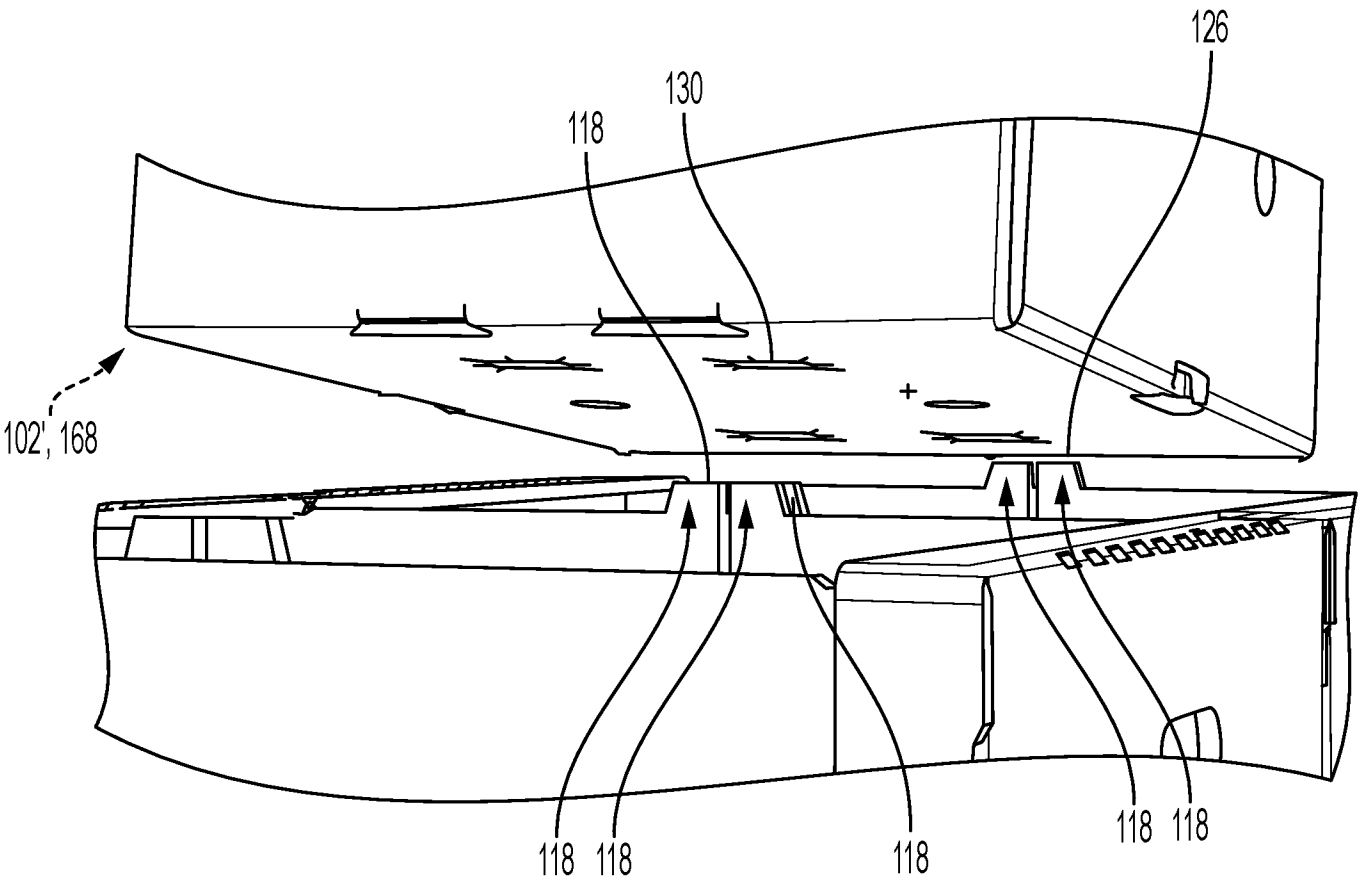
FIG. 16 illustrates a detail-perspective view of the containers illustrated in FIG. 15.

FIGS. 15 & 16 each illustrate perspective views of the second row 168 container 102' being positioned on top of two containers 102 disposed in the first row 148. The containers 102 of the first row 148 may be arranged adjacent to one another so that the stacking tabs 118 of one of the longitudinal walls 128 (see above) are adjacent to one another. As the second row 168 container 102' is placed on top of the first row 148, the lateral edge slots 126 may receive two of the stacking tabs 118 and the bottom wall slot 130 may receive four of the stacking tabs 118.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A container arrangement comprising:

a number of containers configured to be arranged in a stacked configuration for a retail display, the stacked configuration including a first row of containers of the number of containers and a second row of containers of the number of containers disposed on top of the first row of containers, wherein the first row of containers are spaced apart from one another to define a first air channel and a second air channel, wherein the first air channel extends in the first direction and the second air channel extending in a second direction, wherein the second direction is orthogonal to the first direction, and wherein the first and second channels are collectively configured to route air away from the number of containers arranged in the stacked configuration, wherein each container of the number of containers include:

a first pair of sidewalls;

a second pair of sidewalls connected to the first pair of sidewalls, each sidewall of the first pair of sidewalls is longer than each sidewall of the second pair of sidewalls; and a bottom wall extending between the first and second pair of sidewalls, the first and second pair of sidewalls and the bottom wall collectively configured to form a receptacle to receive the produce, the first pair of sidewalls each including a top edge portion provided with a first stacking tab and a second stacking tab each extending away from the bottom wall, the bottom wall defining a first stacking aperture, the first and second stacking tabs having a first dimensional characteristic, the stacking aperture having a second dimensional characteristic such that the first stacking aperture is configured to receive a number of stacking tabs, each stacking tab of the number of stacking tabs having the first dimensional characteristic, and wherein each stacking tab of the number of stacking tab tapers between a bottom portion of each stacking tab to a distal end of each stacking tab.

2. The container arrangement of claim 1, wherein the first dimensional characteristic is based on the taper of each stacking tab of the number of stacking tabs.

3. The container arrangement of claim 1, wherein the second tab is adjacent to the first tab.

4. The container arrangement of claim 1, wherein the second tab is spaced apart from the first tab.

5. The container arrangement of claim 1, wherein the first tab and the second tab are symmetrical to one another.

6. The container arrangement of claim 1, wherein a quantity of the number of stacking tabs is four.

7. The container arrangement of claim 1, wherein the bottom wall and a sidewall of the first pair of sidewalls collectively define a second stacking aperture, the first and second stacking apertures substantially equidistant from a mid-point of the first sidewall.

8. A container arrangement comprising:

a number of containers configured to be arranged in a stacked configuration for a retail display, the stacked configuration including a first row of containers of the number of containers and a second row of containers of the number of containers disposed on top of the first row of containers, each container of the number of containers having a first pair of sidewalls, a second pair of sidewalls, a bottom wall extending between the first and second pair of sidewalls, and a number of stacking tabs each extending from a top portion of the first pair of sidewalls, wherein each stacking tab of the number of stacking tabs tapers from the top portion of the first pair of sidewalls to a distal end of each stacking tab, each sidewall of the first pair of sidewalls having a first length and each sidewall of the second pair of sidewalls having a second length, the first length greater than the second length, the bottom wall defining a first stacking aperture and a second stacking aperture, the first stacking aperture defined by the bottom wall and the second stacking aperture collectively defined by the bottom wall and a sidewall of the second pair of sidewalls the first row of containers including a first container and a second container disposed adjacent to the first container, the first pair of sidewalls of the first and second containers extending along a first direction, so that at least one stacking tab of the first container is adjacent to at least one stacking tab of the second container, the second row of containers including a third container, the second pair of sidewalls of the third container extending along the first direction, and the at least one stacking tab of the first container and the at least one stacking tab of the second container are received by the first stacking aperture of the third container, and one or more other stacking tabs of the at least one stacking tab of the first container is received by the second stacking aperture of the third container so that:

the first row of containers are spaced apart from one another to define a first air channel and a second air channel, wherein the first air channel extends in the first direction and the second air channel extending in a second direction, wherein the second direction is orthogonal to the first direction, and wherein the first and second channels are collectively configured to route air away from the number of containers arranged in the stacked configuration.

9. The container arrangement of claim 8, wherein the second row of containers are spaced apart from one another to define a third air channel and a fourth air channel, wherein the third air channel extends in the first direction and the fourth air channel extends in the second direction, and wherein the first and third air channels are offset from one another with respect to the first direction.

10. The container arrangement of claim 9, wherein the stacked configuration of the number of containers includes a third row of containers disposed on top of the second row of containers, wherein the third row of containers are spaced apart from one another to define a fifth air channel and a sixth air channel, wherein the sixth air channel, the fourth air channel, and the second air channel are collectively arranged to form a zig-zag pattern.

11. A container arrangement configured for transporting and displaying produce within a retail store, the container arrangement comprising:

a number of containers, each container of the number of containers having a rectangular shape and including, a top portion defining an opening configured to provide access to an interior portion of each container, and including a number of stacking tabs, a bottom portion including a bottom wall configured to support the produce, the bottom portion defining a number of stacking slots, each stacking slot of the number of stacking slots configured to receive at least one stacking tab of the number of stacking tabs, and a medial portion disposed between the bottom portion and the top portion, wherein the number of containers include a first container and a second container, and the number of containers are collectively configured to be arranged in one or more stacked configurations, in which at least a portion of the second container is disposed on top of the first container, the one or more stacked configurations including an aligned configuration, in which an outer periphery of the first container is substantially aligned with an outer periphery of the second container, and a first stacking tab of the number of stacking tabs is received by a first stacking slot of the number of stacking slots to detachably connect the first container to the second container, and the one or more stacked configurations including an offset configuration, in which at least a portion of the outer periphery of the first container is offset from an outer periphery of the second container, and a second stacking tab of the number of stacking tabs is received by a second stacking slot of the number of stacking slots to detachably connect the first container to the second container, wherein the medial portion and the top portion of each container of the number of containers is formed by a first pair of sidewalls and a second pair of sidewalls, each sidewall of the first pair of sidewalls being longer than each sidewall of the second pair of sidewalls, wherein the number of stacking tabs extend from the first pair of sidewalls, wherein each stacking tab of the at least one stacking tab tapers between a bottom portion of each stacking tab to a distal end of each stacking tab so that the one or more stacked configurations include a first offset configuration and a second offset configuration disposed adjacent to one another to form first and second air channels.

12. The container arrangement of claim 11, wherein the first stacking slot of the second container is positioned closer to a portion of the outer periphery of the second container than the second stacking slot of the second container.

13. The container arrangement of claim 12, wherein the second stacking slot is formed by an elongated slot and a number of slits each defined by the bottom wall, the elongated slot defining a peripheral edge and the number of slits radially extending from the peripheral edge so that the second stacking slot is configured to receive at least two stacking tabs of the number stacking tabs.

14. The container arrangement of claim 13, wherein the peripheral edge is formed by a pair of longitudinal edge regions, a pair of lateral edge regions, and a number of corner edge regions connecting the pair of longitudinal edge regions to the pair of lateral edge regions, the pair longitudinal edge regions being longer than the pair of lateral edge regions.

15. The container arrangement of claim 12, wherein the number of stacking tabs further include a second stacking tab adjacent to the first stacking tab, and in the offset configuration, the first stacking tab is received by second stacking slot and the second stacking tab is received by a first slit of the number of slits.

* * * * *